United States Patent [19]

Lutz

[11] 4,034,260

[45] July 5, 1977

[54] GRIDDED CROSSED-FIELD TUBE AND IGNITION METHOD

[75] Inventor: Michael A. Lutz, Livermore, Calif.

[73] Assignee: Hughes Aircraft Company, Culver City, Calif.

[22] Filed: Feb. 19, 1976

[21] Appl. No.: 659,604

[52] U.S. Cl. ..... 315/344; 313/161; 313/162; 313/198; 315/267

[51] Int. Cl.[2] ..... H01J 17/14; H01J 17/32

[58] Field of Search ..... 315/236, 267, 338, 344, 315/348; 313/161, 162, 198, 293, 294

[56] References Cited

UNITED STATES PATENTS

| | | | |
|---|---|---|---|
| 3,405,301 | 10/1968 | Hayakawa et al. | 313/162 |
| 3,581,142 | 5/1971 | Boxman | 313/162 |
| 3,714,510 | 1/1973 | Hofmann | 315/267 X |

*Primary Examiner*—Eugene R. La Roche
*Attorney, Agent, or Firm*—Allen A. Dicke, Jr.; W. H. MacAllister

[57] ABSTRACT

In addition to the anode and cathode electrodes which define a low pressure gas filled main gap therebetween and a magnetic field to lengthen the electron path, the crossed-field switch device has a control electrode defining a second gas filled control gap in communication with the first, main conducting gap. An auxiliary voltage supply can be connected to the control gap to ignite a low pressure discharge, and the ionized plasma of this discharge leaks into the first gap to start a discharge in the glow mode.

8 Claims, 5 Drawing Figures

GRIDDED CROSSED-FIELD TUBE AND IGNITION METHOD

BACKGROUND

This invention is directed to a crossed-field switch device and an ignition method therefor whereby the crossed-field switch device can be onswitched with voltage applied without pulsing the magnetic field to a high value.

In recent years crossed-field switch devices have been developed into tubes which are capable of conducting fairly high currents and are capable of off-switching against high voltages. Crossed-field switch devices having a 10,000 ampere DC conducting capability and an offswitching capability against 100 kilovolts have been designed. Such switch devices are believed to have a considerable prospect in the developing field of high power electric transmission by means of direct current links. Such crossed-field switch devices do not have long term conducting capability, and thus must be paralleled during normal conduction. When it is desired to open the circuit, the in-line switch is opened, so that it shunts the current through the crossed-field switch device which is thereupon turned off. U.S. Pat. No. Re. 27,557 illustrates this type of circuit breaker which incorporates a crossed-field switch device as an off-switching component.

There have been a number of developments in the art of the crossed-field switch device which have brought it to this state of utility. Among the background patents on the crossed-field switch devices are U.S. Pat. Nos. 3,638,061; 3,641,384; 3,604,977; 3,558,960; 3,678,289; 3,769,537 and 3,749,978 .

Of course it is necessary to onswitch the crossed-field switch device when current flow therethrough is required. Under the right conditions of applied voltage and magnetic field, initial ionization can come about by the action of cosmic rays. However, in order to reduce the satistical reliance on such events, ignition devices can supply the preionization, (see U.S. Pat. Nos. 3,714,510 and 3,890,520). These patents covering ignition equipment are useful to reduce the ignition time delay whenever the conditions are within the conductive region of the Paschen curve.

Sometimes it is desired to make the crossed-field switch device conductive, that is onswitch the switch device, when the rated line voltage is applied thereacross. This has formerly been done by pulsing the magnetic field sufficiently high that even with voltage applied, the conditions in the interelectrode space move into the conductive region. For example see U.S. Pat. Nos. 3,678,289 and 3,604,977.

However, the firing or ignition of crossed-field switch device at high voltage using a high pulse magnetic field has several disadvantages. There is a time delay from the trigger to the ignition of the crossed-field switch device in the order of 10 microseconds. Furthermore, there is significant jitter in ignition, in the order of 1 microsecond. Additionally, it is difficult to obtain short duration, high level magnetic pulses in the order of 0.1 Tesla or 1 K Gauss in crossed-field switch devices due to the eddy currents created in the electrodes. Also, a high powered magnetic field pulser is a difficult and expensive device, particularly at a high pulse repetition frequency. These requirements also create a more complicated and expensive tube construction which often includes an internal magnetic field coil to minimize the above listed detrimental effects. Thus, it is highly desirable for a crossed-field swtich device to be ignited at high voltage, in the order of 10 to 100 kilovolts, with a relatively low magnetic field, in the order of 0.01 Tesla, or 100 Gauss.

SUMMARY

In order to aid in the understanding of this invention it can be stated in essentially summary form that it is directed to a gridded crossed-field switch device and ignition method therefor. The crossed-field switch device has, in addition to its regular anode and cathode electrodes which define the main interelectrode gap, a control electrode which, together with one of the other electrodes, defines a control interelectrode gap. In addition to magnetic field means, low voltage means is connected to the electrodes adjacent the control gap for igniting an auxiliary glow discharge therein. When high voltage is maintained across the main gap the auxiliary discharge passes into the main gap to cause its ignition into the low pressure glow mode.

It is thus an object of this invention to provide a gridded crossed-field switch which can be onswitched while high voltage is applied without the need for a large magnetic field pulse. It is another object to provide a crossed-field switch device which has three electrodes, which define an ignition gap and a main conducting gap so that ignition can be accomplished within the ignition gap. It is a further object to provide a three electrode crossed-field switch device in which the main gap can be ignited to operate in the crossed-field discharge mode without requiring a pulsed magnetic field. It is a further object to provide a gridded crossed-field switch device which is capable of onswitching by application of voltage pulses to its control electrode.

Other objects and advantages of this invention will become apparent from a study of the following portion of the specification, the claims and the attached drawings.

DESCRIPTION OF THE PREFERRED EMBODIMENT

Figure 1:
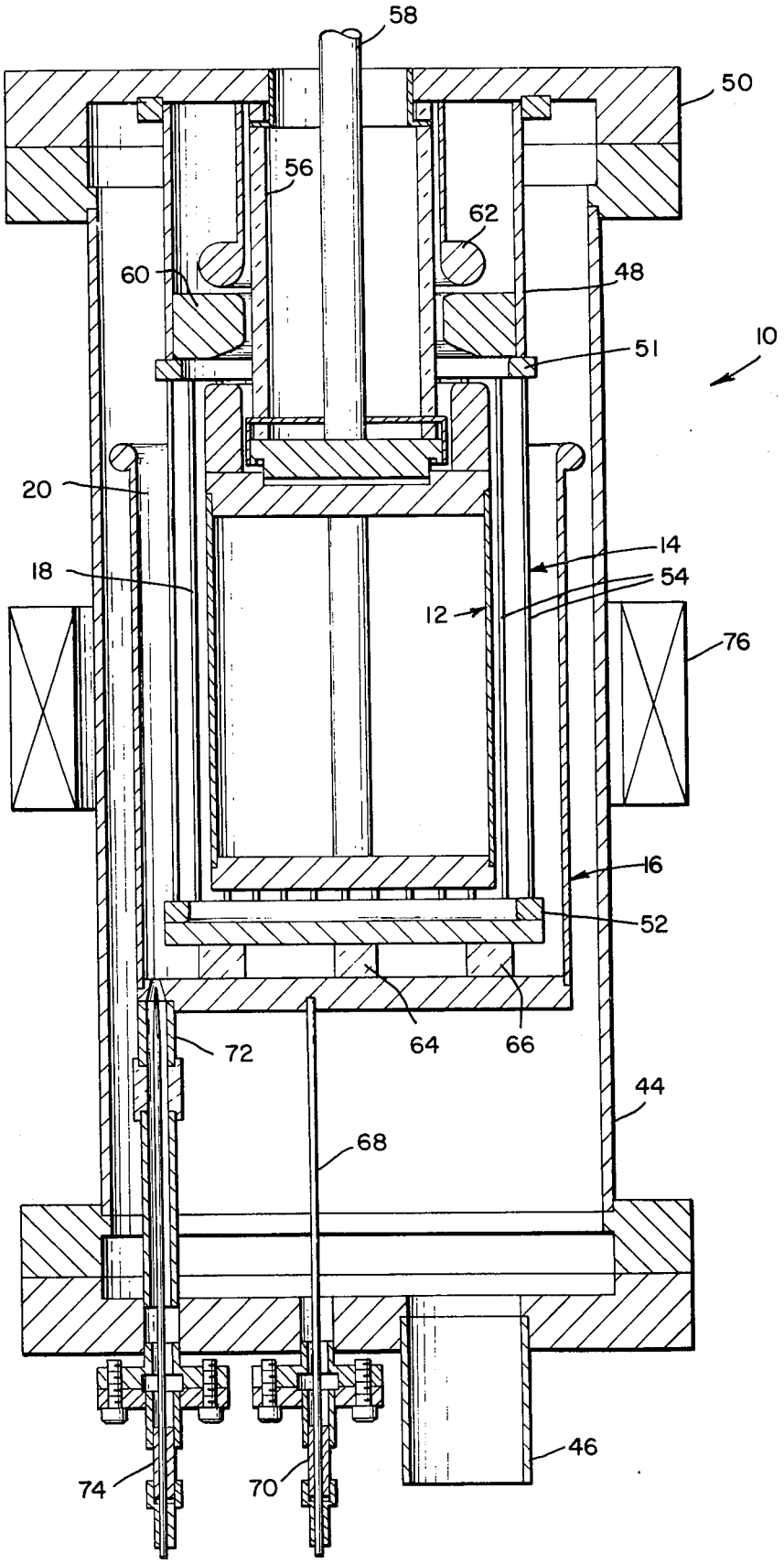
FIG. 1 is a longitudinal section through the gridded crossed-field switch device of this invention.
Figure 3:
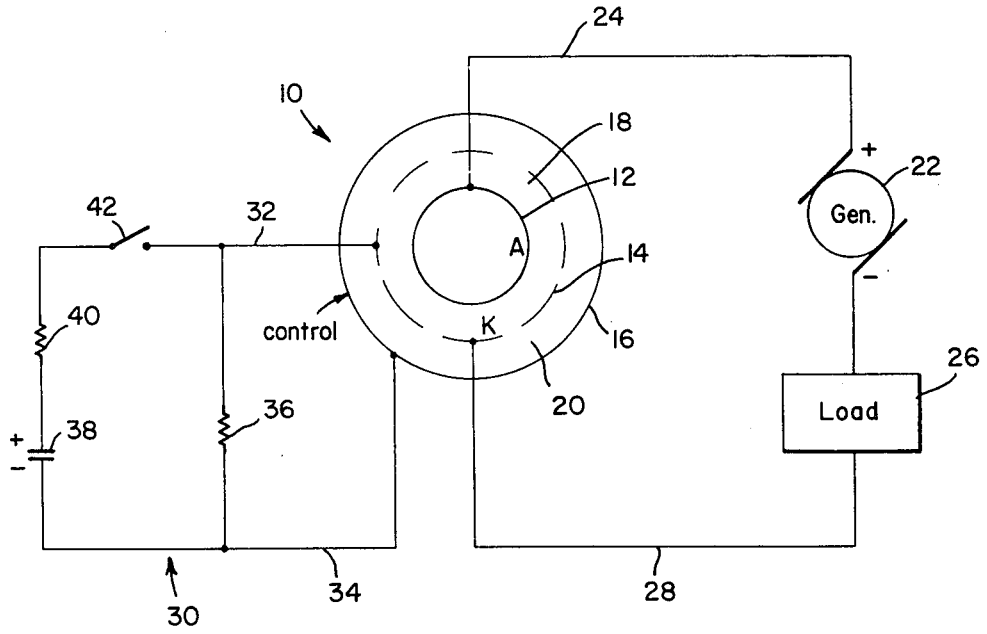
FIG. 3 is a schematic electrical diagram showing the connections of the gridded crossed-field switch device.

The gridded crossed-field switch device of this invention is generally indicated in 10 in FIGS. 1 and 3. In The schematic drawing of FIG. 3, crossed-field switch device 10 is shown as having an anode electrode 12, a cathode electrode 14 and a control electrode 16. As will be described below, the physical arrangement of the electrodes may differ, with the control electrode between the cathode and anode or even interiorly of the anode, but the preferred arrangement is as shown in FIG. 3. These concentric eletrodes define an annular space or gap 18 between the anode and cathode, with the annular space 18 serving as a main gap in which the main glow discharge is formed during conduction.

Cathode electrode 14 and control electrode 16 define between them outer annular space 20 which is the gap in which the ignition discharge is formed. Space 18 and space 20 are each in the order of 1 centimeter in the radial direction. While the crossed-field switch device is shown as being circular, because that is a convenient construction, other geometric constructions are also feasible, so that the gap may not be a circular annulus but may be another shape such as a hollow rectangular or hollow square. Cathode electrode 14 has openings therethrough so that the plasma of a glow discharge in one of the spaces can enter into the other space.

As is seen in FIG. 3 the positive side of generator 22 is connected by line 24 to anode 12, while the negative side of generator 22 is connected through load 26 by line 28 to cathode 14. Thus, the turning on and off of a low pressure glow discharge in the main discharge gap 18 turns on and off current from the generator through the load. Of course FIG. 3 is highly schematic, and the generator 22 represents any source of direct current. Furthermore, the switching on and off of the current through the load is not usually accomplished only by the gridded crossed-field switch device 10 but also by parallel in-line device through which the current passes during long running periods.

Control circuit 30 has line 32 connected to cathode electrode 14 and line 34 connected to the control electrode 16. Resistor 36 is connected between lines 32 and 34 so that unless an additional voltage is supplied, control electrode 16 is at the same potential as cathode 14, by the leakage through the resistor 36. When resistor 36 is of low value, control electrode pulses will pass through it and not be effective due to the excess leakage through the resistor. Also, when the value is too low the cathode and control electrodes will be insufficiently electrically separated. If they can carry substantially the same potential hollow cathode discharge will continue in gap 20 so device 10 cannot be turned off. When resistor 36 is of too high a value the potential of control electrode 16 cannot be properly established prior to the initial start of the magnetic field pulse and spurious turn on may result. A resistance value between 1 Kilohm and 1 megohn satisfies both of these requirements. Control circuit 30 permits voltage pulsing of control electrode 16 with respect to cathode 14. As an example, capacitor 38, capacitor discharge rate limiting resistor 40 and switch 42 are serially connected between lines 34 and 32. Another type of pulse supply can be substituted. A pulse on the order of 1 kilovolt is typical but voltages as low as 300V are feasible.

Figure 2:
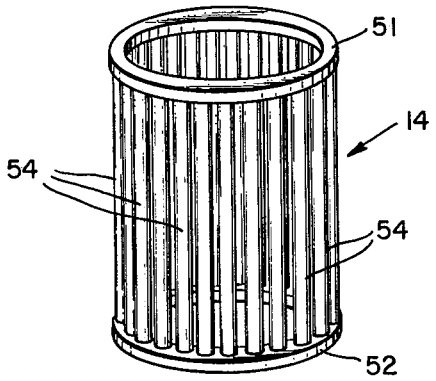
FIG. 2 is a perspective view of one of the electrodes.

FIG. 1 shows in more detail the structure of the gridded crossed-field switch device 10. Outer vessel 44 is the structural enclosure, tank or envelope which encloses the electrodes and their insulated supports. Vessel 44 is vacuum tight with connection 46 permitting drawing of a vacuum on the vessel and maintenance of a proper gas supply therein at a proper pressure. Usually helium at about 50 millitorr is a suitable atmosphere for the low pressure glow crossed-field discharge. Vessel 44 is at cathode potential. It supports cathode 14 on support ring 48 downward from top cover 50. Cathode electrode 14 is formed as a grid or perforated electrode. FIG. 2 shows cathode 14 as being formed of an upper ring 51, lower ring 52 and bars 54 connected therebetween to form an electrode in the form of a squirrel cage. Also, it may be necessary to shield line of sight between 12 and 16 in some cases.

Anode 12 is downwardly supported from upper ring 50 on insulator 56 and is exteriorly connected by lead 58 which is connected to line 24. Insulator 56 is the major insulator which holds off the main anode to cathode voltage. Insulator 56 is supplied with field shaping electrodes 60 and 62 to prevent glow discharge breakdown in that region.

Control electrode 16 is supported beneath cathode 14 on insulators such as the ones shown at 64 and 66. Control electrode 16 is connected by lead 68 which passes through a vacuum tight insulator 70 with respect to vessel 44.

Ionizer 72 is mounted to inject electrons into the outer annular space 20 and its lead comes out through the base by means of a vacuum tight insulator 74. Ionizer 72 can be of the type shown in U.S. Pat. No. 3,890,520.

Figure 5:
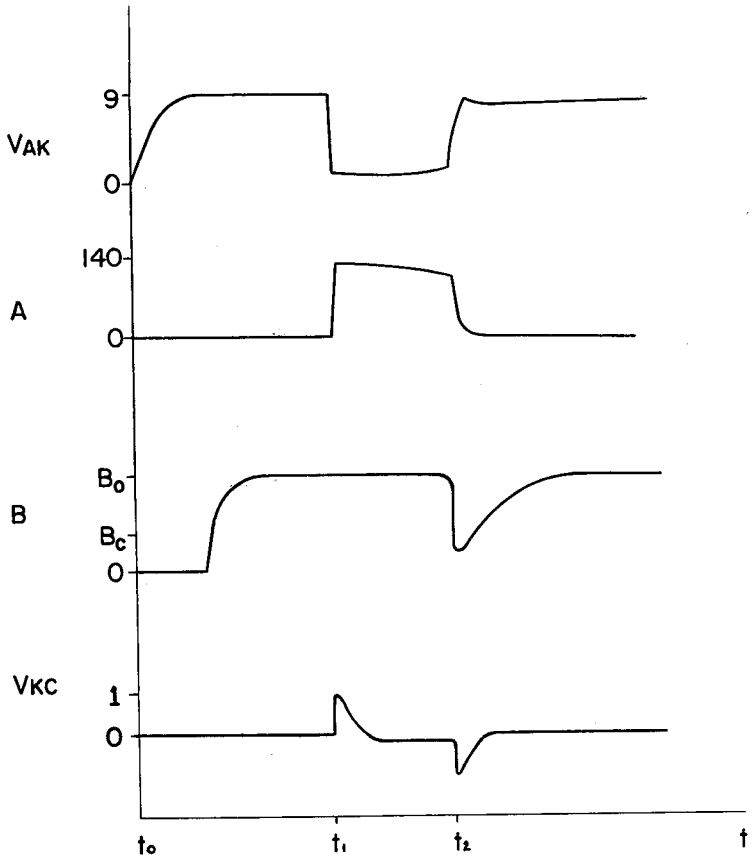
FIG. 5 is a series of graphs showing various parameters in the gridded crossed-field switch device versus time.
Figure 4:
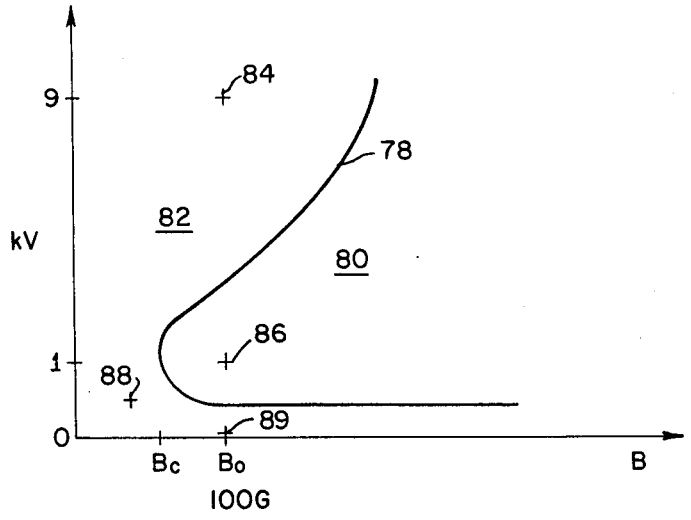
FIG. 4 is a Paschen curve relating the conditions in the interelectrode gaps to the conductive region of the Paschen curve.

In accordance with the physical mechanism by which the discharge operates, an axial magnetic field is provided by solenoid 76. The magnetic field has a value of $B_o$ as shown in FIGS. 4 and 5, which on the order of 100 Gauss for an interelectrode spacing of 1–2 centimeters and with a helium gas filling at 50 millitorr. The magnetic field can be pulsed below the critical value $B_c$, (see FIGS. 4 and 5) which is the leftward end of the toe of Paschen curve 78 which separates the conductive region 80 from the nonconductive region 82.

The function of this equipment is best described by going through an on-off cycle. Referring to FIG. 5, at time $t_o$, 9 kilovolts is first applied to the main gap 18 and a magnetic field of strength $B_o$ is then applied to both gaps. This places the operating condition of the main gap at a point 84 in FIG. 4. This is in the nonconductive region and therefor no current is being conducted by the gridded crossed-field switch device 10. Since control electrode 16 is connected to cathode electrode 14 through leak resistor 36, the voltage of the control electrode C with respect to the cathode K is zero. This places the operating condition of the control gap at point 89 in FIG. 4.

When on-switching is desired, for example at point $t_1$, switch 42 is closed to impress a pulse between the cathode K and the control electrode C to bring the voltage therebetween into the conductive region of the Paschen curve, for example to point 86 in FIG. 4 which represents about 1 kilovolt between the cathode and the control electrode. Under these conditions, a discharge in the control gap initiates. With that gap conducting in the low pressure glow discharge mode, the discharge plasma seeps through the transmissive cathode structure to cause conduction of the main gap 18. The mechanism by which the conduction starts is not clearly understood, because under the initial conditions the gap is in an unconducting region at point 84. However, the presence of glow discharge plasma, which does not seem to need to be sufficient to reach across the entire gap, starts the main gap discharge. With the beginning of that discharge, within microseconds after the on-pulse, and thus both indicated at time $t_1$ in FIG. 5, the voltage across the main gap decreases to the discharge voltage drop, typically 500V.

Conduction continues either to exhaustion of the interelectrode gas, or until magnetic field is suppressed. As is seen in the bottom curve in FIG. 5, the voltage across the ignition gap quickly falls to a lower level, so that discharge in the ignition gap stops due to lack of voltage thereacross. Thus, the ignition gap cannot supply more plasma. Off-switching is then accomplished by pulsing the magnetic field below $B_c$. This pulsing appears at time $t_2$ in FIG. 5 and moves the operating point to point 88 which is in the nonconductive region 82 of the crossed-field breakdown curve of FIG. 4. This causes termination of the main gap discharge with a buildup of voltage between the anode and cathode and a termination of the current flow therebetween. In this way the on-off cycle is complete.

The squirrel cage type of structure shown in FIG. 2 is an example of a preferred structure. Basically, cathode electrode 14 must have sufficient material to develop the electric field and participate in the discharge. However, it must be open enough to permit the glow discharge plasma to seep through from the outer ignition discharge gap to the main gap. A perforated tube can accomplish the same result, and in some cases the perforations may need to be shielded. The preferred maximum open area has not yet been experimentally established, however the cathode electrode 14 of about 30 percent open area has been found to be feasible.

In the device actually reduced to practice, resistor 36 was about 1 kilohm and such a resistor seemed to be necessary to produce the correct discharge. FIG. 5 illustrates the maximum voltage applied as being 9 kilovolts, but the limitation to this value was introduced by the isolation resistors between the electrodes rather than a fundamental limitation of the physical process. In fact, ignition of 50 kV has been performed in the above described manner.

Several references has been made to prior patents. These patents are incorporated into this specification in their entirety by this reference. This invention having been described as preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A crossed-field switch device comprising:

a tubular anode electrode and a tubular cathode electrode spaced from said anode electrode, said electrodes having active areas that face to form a continuous closed main discharge gap therebetween and means for making electrical connections to said anode and said cathode electrodes and means for providing a gas at sub-atmospheric pressure in said main discharge gap and a magnetic field above the critical value in said main discharge gap so that a glow mode plasma discharge can take place between said anode and said cathode electrodes for conduction of said switch device, the improvement comprising:

a tubular control electrode postioned adjacent to one of said anode and cathode electrodes to form a continuous closed ignition discharge gap adjacent to, over the whole area of and in communication with said main discharge gap; and means for electrically pulsing said control electrode with respect to its adjacent electrode on the other side of said ignition discharge gap for bringing conditions in said ignition discharge gap into conductive conditions so that glow mode plasma discharge begins in said ignition discharge gap and enters into the entire area of said main discharge gap to cause conductive condition of said main discharge gap over all of its area so that said crossed-field switch device can be turned on with voltage applied thereto without magnetic field pulsing and with uniform wear of said anode and cathode electrodes over their entire active areas.

2. The crossed-field switch device of claim 1 wherein said electrode which acts in association with both said ignition gap and said main gap has openings therethrough to permit passage of glow mode discharge plasma from said ignition discharge gap to said main discharge gap.

3. The crossed-field switch device claim 2 wherein said cathode electrode and said control electrode are both positioned outside of said anode electrode.

4. The crossed-field switch device of claim 3 wherein said control electrode is positioned outside of and embraces said cathode electrode and said cathode electrode is positioned outside of and embraces said anode electrode.

5. The crossed-field switch device of claim 2 wherein said anode electrode and said cathode electrode are both positioned inside of said control electrode.

6. The crossed-field switch device of claim 5 wherein said control electrode forms the outermost electrode, said anode electrode forms the inner electrode and said cathode electrode is positioned between said anode electrode and said control electrode to form on its interior said main discharge gap and on its exterior said ignition discharge gap.

7. The crossed-field switch device of claim 6 wherein said electrodes are in the form of coaxially positioned cylindrical tubes so that said gaps are annular gaps.

8. The method of on-switching a crossed-field switch device having tubular electrodes forming an annular ignition gap facing substantially the entire active area and connected thereto, a vessel for maintaining a selected gass fill in the gaps, a magnet for providing a magnetic field of a value only sufficient to support crossed-field discharge in the main and ignition gaps, comprising the steps of:

voltage pulsing the ignition gap to a value for crossed-field discharge through substantially the entire gap; and permitting the discharge plasma to enter substantially the entire active area of the main gap so that it conducts over the entire active area.

* * * * *